US011759024B2

(12) United States Patent
Murray

(10) Patent No.: US 11,759,024 B2
(45) Date of Patent: Sep. 19, 2023

(54) BED ROLL GUARD

(71) Applicant: Oolie Inc., Portland, OR (US)

(72) Inventor: Nora Murray, Portland, OR (US)

(73) Assignee: OOLIE INC., Portland, OR (US)

( * ) Notice: Subject to any disclaimer, the term of this patent is extended or adjusted under 35 U.S.C. 154(b) by 0 days.

(21) Appl. No.: 17/545,367

(22) Filed: Dec. 8, 2021

(65) Prior Publication Data

US 2023/0172365 A1 Jun. 8, 2023

(51) Int. Cl.
*A47C 21/08* (2006.01)

(52) U.S. Cl.
CPC ..... *A47C 21/08* (2013.01)

(58) Field of Classification Search
CPC ..... A47D 15/008; A47C 21/08
See application file for complete search history.

(56) References Cited

U.S. PATENT DOCUMENTS 2,430,240 A * 11/1947 Nathan ..... A45C 11/04 206/5
6,848,130 B1 * 2/2005 Wilson ..... A47C 21/08 5/427
7,904,977 B1 * 3/2011 Singh ..... A47G 9/0246 5/497
2021/0037995 A1 * 2/2021 Dompierre ..... A47C 31/10

* cited by examiner

*Primary Examiner* — David R Hare
*Assistant Examiner* — Adam C Ortiz
(74) *Attorney, Agent, or Firm* — Fredrikson & Byron, P.A.

(57) ABSTRACT

A bed roll guard apparatus includes a base sheet having an end portion with an elastic band configured to be secured to a mattress. A first longitudinal pocket of the apparatus includes a first longitudinal pocket inner end coupled to the base sheet and a first longitudinal pocket outer end coupled to the base sheet and different in length than the first longitudinal pocket inner end. The second longitudinal pocket of the apparatus includes a second longitudinal pocket inner end coupled to the base sheet and a second longitudinal pocket outer end coupled to the base sheet and different in length than the second longitudinal pocket inner end. The first and second longitudinal pockets define, respectively, first and second bolster receptacle spaces between the respective first and second longitudinal pockets and the base sheet. First and second bolsters are received at the first and second bolster receptacle spaces, respectively.

15 Claims, 9 Drawing Sheets

BED ROLL GUARD

TECHNICAL FIELD

This disclosure generally relates to bed roll guard apparatuses, systems, and methods. Certain such embodiments are described herein in the context of a bed roll guard that is configured to be laid over a mattress to promote spatial awareness and help prevent a user from rolling off the mattress during sleep.

BACKGROUND

Bed roll guards can be used to reduce instances of a user rolling out of bed during sleep. However, available bed roll guards, such bed rail assemblies, are typically bulky, require labor-intensive assembly of many discrete components, and tend to lack robust structural stability if not installed precisely. Moreover, in addition to these issues, these available bed roll guards tend to make inefficient use of raw material, thus resulting in an unnecessarily large environmental footprint for a product that can be overly complex and inefficient. And, the relatively large number of components of these available bed roll guards can act to increase risk of injury, including entrapment and suffocation.

SUMMARY

In general, various embodiments relating to bed roll guard apparatuses, systems, and methods are disclosed herein. In particular, embodiments disclosed herein can help to prevent a user from rolling out of bed during sleep yet be relatively easy to install and have the capability to be portable and efficient for storage. At the same time, certain such bed roll guard apparatus and method embodiments disclosed herein can include one or more features that allow for efficient use of material so as to reduce material waste and, as a result, provide an environmentally conscious product. As such, embodiments disclosed herein can both improve the ease and convenience associated with using a bed roll guard while also providing a more environmentally friendly product.

One embodiment includes a bed roll guard apparatus. This bed roll guard apparatus embodiment includes a base sheet, a first longitudinal pocket, a first bolster, a second longitudinal pocket, and a second bolster. The base sheet includes an end portion having an elastic band that is configured to be secured to a mattress. The first longitudinal pocket includes a first longitudinal pocket inner end coupled to the base sheet and a first longitudinal pocket outer end coupled to the base sheet. The first longitudinal pocket inner end is different in length than the first longitudinal pocket outer end. The first longitudinal pocket defines a first bolster receptacle space between the first longitudinal pocket and the base sheet. The first bolster is received at the first bolster receptacle space. The second longitudinal pocket includes a second longitudinal pocket inner end coupled to the base sheet and a second longitudinal pocket outer end coupled to the base sheet. The second longitudinal pocket inner end is different in length than the second longitudinal pocket outer end. The second longitudinal pocket defines a second bolster receptacle space between the second longitudinal pocket and the base sheet. The second bolster is received at the second bolster receptacle space.

In a further embodiment of this apparatus, the first longitudinal pocket outer end can include a first fastening mechanism to removably couple the first longitudinal pocket outer end to the base sheet, and the second longitudinal pocket outer end can include a second fastening mechanism to removably couple the second longitudinal pocket outer end to the base sheet. The first fastening mechanism can be a first zipper, and the first longitudinal pocket outer end can includes a first zipper first portion and the base sheet can include a first zipper second portion. The first zipper first portion can be complementary to the first zipper second portion such that the first zipper first portion is configured to be removably coupled to the first zipper second portion to removably couple the first longitudinal pocket outer end to the base sheet. Likewise, the second fastening mechanism can be a second zipper, and the second longitudinal pocket outer end can include a second zipper first portion and the base sheet can include a second zipper second portion. The second zipper first portion can be complementary to the second zipper second portion such that the second zipper first portion is configured to be removably coupled to the second zipper second portion to removably couple the second longitudinal pocket outer end to the base sheet.

In a yet further embodiment of this apparatus, the first longitudinal pocket inner end can be longer than the first longitudinal pocket outer end, and the second longitudinal pocket inner end can be longer than the second longitudinal pocket outer end. The first longitudinal pocket can further include a first longitudinal pocket first radial end extending at an oblique angle between the first longitudinal pocket inner end and the first longitudinal pocket outer end at a first radial end of the first longitudinal pocket. And, the first longitudinal pocket can still further include a first longitudinal pocket second radial end extending at an oblique angle between the first longitudinal pocket inner end and the first longitudinal pocket outer end at a second radial end of the first longitudinal pocket, with the first radial end of the first longitudinal pocket being opposite the second radial end of the first longitudinal pocket. The first longitudinal pocket first radial end can define a first bolster opening, at the first longitudinal pocket, leading to the first bolster receptacle space between the first longitudinal pocket and the base sheet. And, the first longitudinal pocket second radial end can define a second bolster opening, at the first longitudinal pocket, leading to the first bolster receptacle space between the first longitudinal pocket and the base sheet. The second bolster opening can be located at an opposite end of the first longitudinal pocket from the first bolster opening.

In a still further embodiment of this apparatus, the bed roll apparatus can additionally include a first radial pocket. The first radial pocket can include a first radial pocket inner end coupled to the base sheet and a first radial pocket outer end coupled to the base sheet. The first radial pocket inner end can be different in length than the first radial pocket outer end. The first radial pocket can define a third bolster receptacle space between the first radial pocket and the base sheet. The bed roll apparatus can also include a third bolster received at the third bolster receptacle space. The first radial pocket inner end can be longer than the first radial pocket outer end. The first radial pocket outer end can include a third fastening mechanism to removably couple the first radial pocket outer end to the base sheet. The third fastening mechanism can be a third zipper. The first radial pocket outer end can include a third zipper first portion and the base sheet can include a third zipper second portion. The third zipper first portion can be complementary to the third zipper second portion such that the third zipper first portion is configured to be removably coupled to the third zipper second portion to removably couple the first radial pocket outer end to the base sheet.

In another further embodiment of this apparatus, the first radial pocket additionally includes a first radial pocket first longitudinal end extending at an oblique angle between the first radial pocket inner end and the first radial pocket outer end at a first longitudinal end of the first radial pocket. And, the first radial pocket additionally includes a first radial pocket second longitudinal end extending at an oblique angle between the first radial pocket inner end and the first radial pocket outer end at a second longitudinal end of the first radial pocket. The first longitudinal end of the first radial pocket is opposite the second longitudinal end of the first radial pocket. The first radial pocket first longitudinal end can define a third bolster opening, at the first radial pocket, leading to the third bolster receptacle space between the first radial pocket and the base sheet.

Another embodiment includes a method of making a bed roll guard apparatus. This method embodiment includes the steps of cutting a plurality of pocket components out of a first material piece, attaching a fastening mechanism first portion to each of the plurality of pocket components, and cutting each of four corners out of a second material piece to form a base sheet. The base sheet includes an end portion having an elastic band that is configured to be secured to a mattress. This method embodiment also includes the step of attaching a plurality of fastening mechanism second portions to the base sheet at locations inward from the end portion having the elastic band. Each fastening mechanism second portion can be configured to removably couple to the fastening mechanism first portion of a respective one of the plurality of pocket components to removably couple the respective one of the plurality of pocket components to the base sheet. This method embodiment additionally includes the step of attaching the plurality of pocket components to the base sheet to form a bolster receptacle space between each of the plurality of pocket components and the base sheet.

In a further embodiment of this method, the plurality of pocket components cut out of the first material piece include a first plurality of pocket components each defining a first area and a second plurality of pocket components each defining a second area, with the second area being different than the first area.

In a yet further embodiment of this method, the plurality of pocket components each include an inner end and an outer end. The inner end can be longer than the outer end. The inner end can be positioned at an opposite end of each of the plurality of pocket components from the outer end, and the fastening mechanism first portion can be attached to the outer end of each of the plurality of pocket components. Each of the plurality of pocket components can be attached to the base sheet via stitching along the inner end of each of the plurality of pocket components. In some examples, this method embodiment can also include the step of removably coupling the fastening mechanism first portion of each of the plurality of pocket components to a respective one of the fastening mechanism second portions to removably couple the outer end of each of the plurality of pocket components to the base sheet.

In an additional further embodiment of this method, the method can also include the step of attaching the elastic band to the end portion of the base sheet.

The details of one or more examples are set forth in the accompanying drawings and the description below. Other features, objects, and advantages will be apparent from the description and drawings.

BRIEF DESCRIPTION OF THE DRAWINGS

The following drawings are illustrative of particular embodiments of the present invention and therefore do not limit the scope of the invention. The drawings are intended for use in conjunction with the explanations in the following description. Embodiments of the invention will hereinafter be described in conjunction with the appended drawings, wherein like numerals denote like elements. The drawings are not necessarily to scale, though certain embodiments can include one or more components at the scale shown.

FIG. 3A is a top plan view of a first material piece from which a plurality of pocket components is cut out. FIG. 3B is a top plan view of a plurality of the pocket components with a fastening mechanism first portion attached to each of the pocket components. FIG. 3C is a top plan view of a second material piece from which the base sheet is formed. FIG. 3D is a top plan view of the base sheet with a plurality of fastening mechanism second portions attached thereto. FIG. 3E is a top plan view of the base sheet with the pocket components attached to the base sheet at locations spaced apart from the fastening mechanism second portions at the base sheet. FIG. 3F is a perspective view of the base sheet, along with the attached pocket components, with an elastic band attached to an end portion of the base sheet. FIG. 3G is a perspective view of the pocket components being removably coupled to the base sheet via the complementary fastening mechanism first and second portions so as to form a bolster receptacle space between each of the plurality of pocket components and the base sheet.

DETAILED DESCRIPTION

The following detailed description is exemplary in nature and is not intended to limit the scope, applicability, or configuration of the invention in any way. Rather, the following description provides some practical illustrations for implementing embodiments of the present invention. Examples of constructions, materials, and/or dimensions are provided for selected elements. Those skilled in the art will recognize that many of the noted examples have a variety of suitable alternatives.

Figure 1:
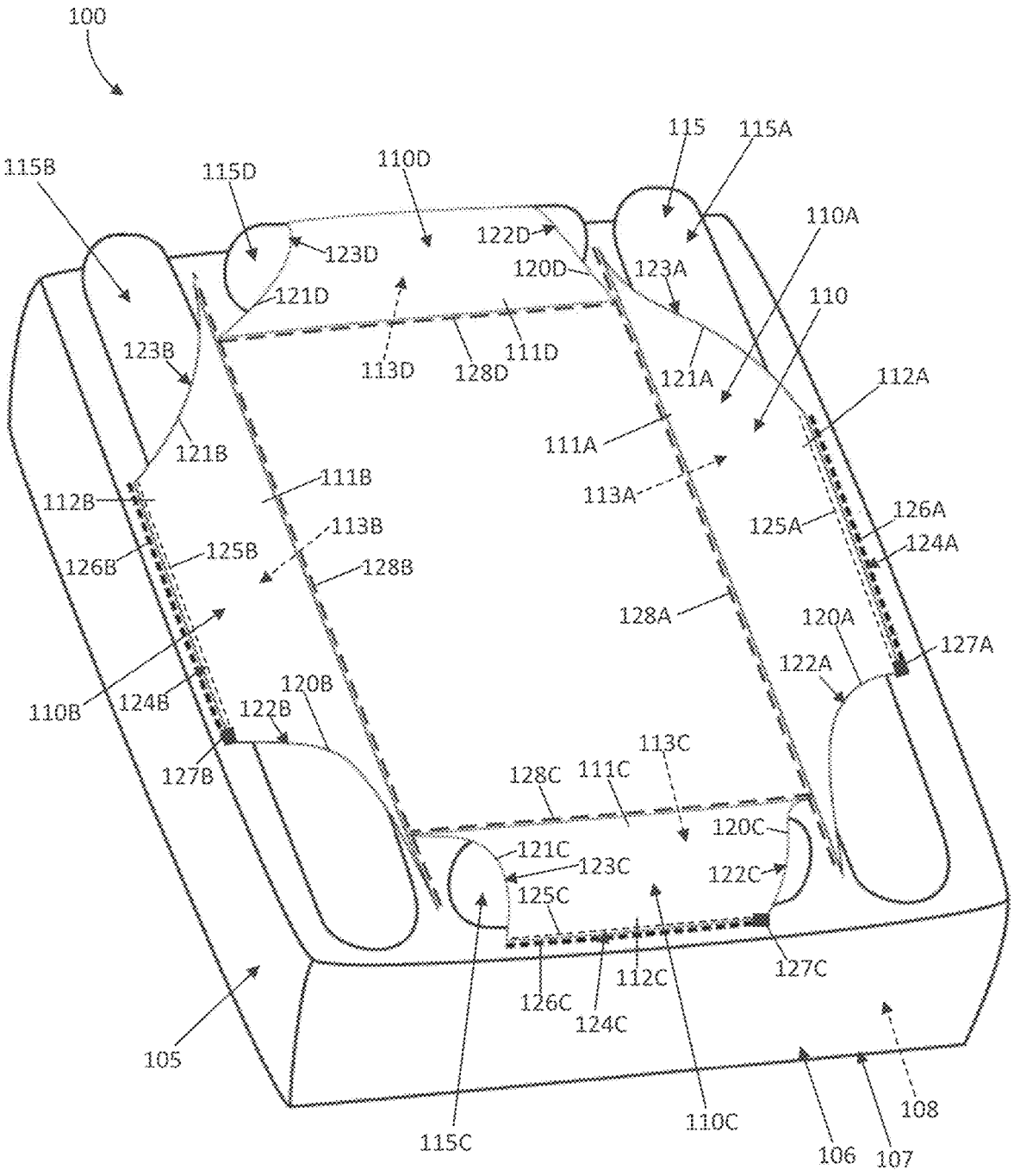
FIG. 1 is a perspective view of an embodiment of a bed roll guard apparatus.

FIG. 1 shows a perspective view of an exemplary embodiment of a bed roll guard apparatus 100. The bed roll guard apparatus 100 can include a base sheet 105, one or more pockets 110, and one or more bolsters 115. More specifically, the illustrated embodiment of the bed roll guard apparatus 100 includes the base sheet 105, a first longitudinal pocket 110A, a first bolster 115A, a second longitudinal pocket 110B, and a second bolster 115B. Some embodiments of the bed roll guard apparatus, such as the illustrated embodiment of the bed roll guard apparatus 100, can further include one or more radial pockets, such as a first radial pocket 110C and/or a second radial pocket 110D. Likewise, when one or more radial pockets 110C, 110D are included, the bed roll guard apparatus 100 can also include one or more associated bolsters, such as a third bolster 115C and/or a fourth bolster 115D associated, respectively, with the first radial pocket 110C and the second radial pocket 110D.

The base sheet 105 can be configured to secure to a mattress 108 or other suitable substrate. For example, the base sheet 105 can include an elastic band 107 that is configured to be secured to the mattress 108, for instance around a perimeter of the mattress 108. In the illustrated embodiment, the base sheet 105 includes an end portion 106 having the elastic band 107 that is configured to be secured to the mattress 108. With the base sheet 105 configured to secure to the mattress 108, the bed roll guard apparatus 100 can be configured to lay over (e.g., on top of) the mattress 108. This configuration of the bed roll guard apparatus 100 can be useful in providing a relatively lightweight and portable apparatus that can be efficiently moved and stored yet at the same time allow for convenient cleaning or other maintenance activity associated with the bed roll guard apparatus 100.

The first longitudinal pocket 110A can include a first longitudinal pocket inner end 111A coupled to the base sheet 105 and a first longitudinal pocket outer end 112A coupled to the base sheet 105. The first longitudinal pocket inner end 111A can be different in length than the first longitudinal pocket outer end 112A. For example, as shown for the illustrated embodiment, the first longitudinal pocket inner end 111A can be longer than the first longitudinal pocket outer end 112A.

In various embodiments, including the illustrated embodiment of the bed roll guard apparatus 100, at least one of the first longitudinal pocket inner end 111A and the first longitudinal pocket outer end 112A can be removably coupled to the base sheet 105. In the illustrated embodiment, the first longitudinal pocket outer end 112A is removably coupled to the base sheet 105. For example, the first longitudinal pocket outer end 112A can include a first fastening mechanism 124A to removably couple the first longitudinal pocket outer end 112A to the base sheet 105. In one embodiment, the first fastening mechanism 124A can be a first zipper, with the first longitudinal pocket outer end 112A including a first zipper first portion 125A and the base sheet 105 including a first zipper second portion 126A. The first zipper first portion 125A can be complementary to the first zipper second portion 126A such that the first zipper first portion 125A is configured to be removably coupled to the first zipper second portion 126A to removably couple the first longitudinal pocket outer end 112A to the base sheet 105. Also, when the first fastening mechanism 124A is a first zipper it can further include a first movable zipper member 127A that is configured to move along both the complementary first zipper first portion 125A and first zipper second portion 126A to cause the first zipper first portion 125A and first zipper second portion 126A to mesh, and thus couple, when the first movable zipper member 127A is moved there along in a first direction and to cause the first zipper first portion 125A and first zipper second portion 126A to separate, and thus de-couple, when the first movable zipper member 127A is moved in a second, opposite direction there along.

In some embodiments where one of the first longitudinal pocket inner end 111A and the first longitudinal pocket outer end 112A is removably coupled to the base sheet 105, the other one of the first longitudinal pocket inner end 111A and first longitudinal pocket outer end 112A can be non-removably coupled to the base sheet 105. For instance, the other one of the first longitudinal pocket inner end 111A and first longitudinal pocket outer end 112A can be non-removably coupled to the base sheet 105 via stitching 128A between the other, non-removably coupled one of the first longitudinal pocket inner end 111A and first longitudinal pocket outer end 112A and the base sheet 105. In the illustrated embodiment, the first longitudinal pocket outer end 112A is removably coupled to the base sheet 105 via the first fastening mechanism 124A while the first longitudinal pocket inner end 111A is non-removably coupled to the base sheet 105 via the stitching 128A between the first longitudinal pocket inner end 111A and the base sheet 105.

The first longitudinal pocket 110A can further include, at a first radial end of the first longitudinal pocket 110A, a first longitudinal pocket first radial end 120A, and the first longitudinal pocket 110A can further include, at a second radial end of the first longitudinal pocket 110A, a first longitudinal pocket second radial end 121A. The first radial end of the first longitudinal pocket 110A can be opposite the second radial end of the first longitudinal pocket 110A. The first longitudinal pocket first radial end 120A can extend at an oblique angle between the first longitudinal pocket inner end 111A and the first longitudinal pocket outer end 112A at the first radial end of the first longitudinal pocket 110A. For instance, the first longitudinal pocket first radial end 120A can extend between the first longitudinal pocket inner end 111A and the first longitudinal pocket outer end 112A at an angle between ten and eighty degrees, between twenty and seventy degrees, or between thirty and sixty degrees. Moreover, in some examples, such as that illustrated, the first longitudinal pocket first radial end 120A can extend at the oblique angle, between the first longitudinal pocket inner end 111A and the first longitudinal pocket outer end 112A, at a curved (e.g., non-linear) orientation. And, likewise, the first longitudinal pocket second radial end 121A can extend at an oblique angle between the first longitudinal pocket inner end 111A and the first longitudinal pocket outer end 112A at the second, opposite radial end of the first longitudinal pocket 110A. For instance, the first longitudinal pocket second radial end 121A can extend between the first longitudinal pocket inner end 111A and the first longitudinal pocket outer end 112A at an angle between ten and eighty degrees, between twenty and seventy degrees, or between thirty and sixty degrees. Moreover, in some examples, such as that illustrated, the first longitudinal pocket second radial end 121A can extend at the oblique angle, between the first longitudinal pocket inner end 111A and the first longitudinal pocket outer end 112A, at a curved (e.g., non-linear) orientation.

The first longitudinal pocket 110A can be configured to receive and hold at least a portion of the first bolster 115A. In particular, the first longitudinal pocket 110A can define a first bolster receptacle space 113A between the first longitudinal pocket 110A and the base sheet 105, and the first bolster receptacle space 113A can be configured to receive and hold the first bolster 115A. The first longitudinal pocket first radial end 120A can define a first bolster opening 122A, at the first longitudinal pocket 110A, leading to the first bolster receptacle space 113A between the first longitudinal pocket 110A and the base sheet 105. And, the first longitudinal pocket second radial end 121A can define a second bolster opening 123A, at the first longitudinal pocket 110A, leading to the first bolster receptacle space 113A between the first longitudinal pocket 110A and the base sheet 105. As shown, this second bolster opening 123A can thus be located at an opposite end of the first longitudinal pocket 110A from the first bolster opening 122A. As such, the first bolster receptacle space 113A can be bounded by the first longitudinal pocket inner end 111A, the first longitudinal pocket outer end 112A, the first longitudinal pocket first radial end 120A, the first longitudinal pocket second radial end 121A, and the portion of the first longitudinal pocket 110A extending between these ends 111A, 112A, 120A, 121A. The first bolster 115A can be received at the first bolster receptacle space 113A. Indeed, in some embodiments, such as that shown at FIG. 1, the first bolster receptacle space 113A can be configured to receive and hold a central region of the first bolster 115A while opposite longitudinal end portions of the first bolster 115A can extend outside of the first bolster receptacle space 113A.

The second longitudinal pocket 110B can include a second longitudinal pocket inner end 111B coupled to the base sheet 105 and a second longitudinal pocket outer end 112B coupled to the base sheet 105. The second longitudinal pocket inner end 111B can be different in length than the second longitudinal pocket outer end 112B. For example, as shown for the illustrated embodiment, the second longitudinal pocket inner end 111B can be longer than the second longitudinal pocket outer end 112B.

In various embodiments, including the illustrated embodiment of the bed roll guard apparatus 100, at least one of the second longitudinal pocket inner end 111B and the second longitudinal pocket outer end 112B can be removably coupled to the base sheet 105. In the illustrated embodiment, the second longitudinal pocket outer end 112B is removably coupled to the base sheet 105. For example, the second longitudinal pocket outer end 112B can include a second fastening mechanism 124B to removably couple the second longitudinal pocket outer end 112B to the base sheet 105. In one embodiment, the second fastening mechanism 124B can be a second zipper, with the second longitudinal pocket outer end 112B including a second zipper first portion 125B and the base sheet 105 including a second zipper second portion 126B. The second zipper first portion 125B can be complementary to the second zipper second portion 126B such that the second zipper first portion 125B is configured to be removably coupled to the second zipper second portion 126B to removably couple the first longitudinal pocket outer end 112B to the base sheet 105. Also, when the second fastening mechanism 124B is a second zipper it can further include a second movable zipper member 127B that is configured to move along both the complementary second zipper first portion 125B and second zipper second portion 126B to cause the second zipper first portion 125B and second zipper second portion 126B to mesh, and thus couple, when the second movable zipper member 127B is moved there along in a first direction and to cause the second zipper first portion 125B and second zipper second portion 126B to separate, and thus de-couple, when the second movable zipper member 127B is moved in a second, opposite direction there along.

In some embodiments where one of the second longitudinal pocket inner end 111B and the second longitudinal pocket outer end 112B is removably coupled to the base sheet 105, the other one of the second longitudinal pocket inner end 111B and second longitudinal pocket outer end 112B can be non-removably coupled to the base sheet 105. For instance, the other one of the second longitudinal pocket inner end 111B and second longitudinal pocket outer end 112B can be non-removably coupled to the base sheet 105 via stitching 128B between the other, non-removably coupled one of the second longitudinal pocket inner end 111B and second longitudinal pocket outer end 112B and the base sheet 105. In the illustrated embodiment, the second longitudinal pocket outer end 112B is removably coupled to the base sheet 105 via the second fastening mechanism 124B while the second longitudinal pocket inner end 111B is non-removably coupled to the base sheet 105 via the stitching 128B between the second longitudinal pocket inner end 111B and the base sheet 105.

The second longitudinal pocket 110B can further include, at a first radial end of the second longitudinal pocket 110B, a second longitudinal pocket first radial end 120B, and the second longitudinal pocket 110B can further include, at a second radial end of the second longitudinal pocket 110B, a second longitudinal pocket second radial end 121B. The first radial end of the second longitudinal pocket 110B can be opposite the second radial end of the second longitudinal pocket 110B. The second longitudinal pocket first radial end 120B can extend at an oblique angle between the second longitudinal pocket inner end 111B and the second longitudinal pocket outer end 112B at the first radial end of the second longitudinal pocket 110B. For instance, the second longitudinal pocket first radial end 120B can extend between the second longitudinal pocket inner end 111B and the second longitudinal pocket outer end 112B at an angle between ten and eighty degrees, between twenty and seventy degrees, or between thirty and sixty degrees. Moreover, in some examples, such as that illustrated, the second longitudinal pocket first radial end 120B can extend at the oblique angle, between the second longitudinal pocket inner end 111B and the second longitudinal pocket outer end 112B, at a curved (e.g., non-linear) orientation. And, likewise, the second longitudinal pocket second radial end 121B can extend at an oblique angle between the second longitudinal pocket inner end 111B and the second longitudinal pocket outer end 112B at the second, opposite radial end of the second longitudinal pocket 110B. For instance, the second longitudinal pocket second radial end 121B can extend between the second longitudinal pocket inner end 111B and the second longitudinal pocket outer end 112B at an angle between ten and eighty degrees, between twenty and seventy degrees, or between thirty and sixty degrees. Moreover, in some examples, such as that illustrated, the second longitudinal pocket second radial end 121B can extend at the oblique angle, between the second longitudinal pocket inner end 111B and the second longitudinal pocket outer end 112B, at a curved (e.g., non-linear) orientation.

The second longitudinal pocket 110B can be configured to receive and hold at least a portion of the second bolster 115B. In particular, the second longitudinal pocket 110B can define a second bolster receptacle space 113B between the second longitudinal pocket 110B and the base sheet 105, and the second bolster receptacle space 113B can be configured to receive and hold the second bolster 115B. The second longitudinal pocket first radial end 120B can define a third bolster opening 122B, at the second longitudinal pocket 110B, leading to the second bolster receptacle space 113B between the second longitudinal pocket 110B and the base sheet 105. And, the second longitudinal pocket second radial end 121B can define a fourth bolster opening 123B, at the second longitudinal pocket 110B, leading to the second bolster receptacle space 113B between the second longitudinal pocket 110B and the base sheet 105. As shown, this fourth bolster opening 123B can thus be located at an opposite end of the second longitudinal pocket 110B from the third bolster opening 122B. As such, the second bolster receptacle space 113B can be bounded by the second longitudinal pocket inner end 111B, the second longitudinal pocket outer end 112B, the second longitudinal pocket first radial end 120B, the second longitudinal pocket second radial end 121B, and the portion of the second longitudinal pocket 110B extending between these ends 111B, 112B, 120B, 121B. The second bolster 115B can be received at the second bolster receptacle space 113B. Indeed, in some embodiments, such as that shown at FIG. 1, the second bolster receptacle space 113B can be configured to receive and hold a central region of the second bolster 115B while opposite longitudinal end portions of the second bolster 115B can extend outside of the second bolster receptacle space 113B.

As noted, the bed roll guard apparatus 100 can additionally include one or more radial pockets, such as the first radial pocket 110C and/or the second radial pocket 110D. And, likewise, when one or more radial pockets 110C, 110D are included, the bed roll guard apparatus 100 can also include one or more associated bolsters, such as the third bolster 115C and/or the fourth bolster 115D associated, respectively, with the first radial pocket 110C and the second radial pocket 110D. The configuration and features of the first and second radial pockets 110C, 110D can be the same as, or similar to, that described with respect to the first and second longitudinal pockets 110A, 110B except that the first and second radial pockets 110C, 110D extend in a radial direction along the base sheet 105 as opposed to the longitudinal direction along the base sheet 105 at which the first and second longitudinal pockets 110A, 110B extend. Thus, when included, the first and/or second radial pockets 110C, 110D can extend in a direction generally perpendicular to the first and second longitudinal pockets 110A, 110B.

The first radial pocket 110C can include a first radial pocket inner end 111C coupled to the base sheet 105 and a first radial pocket outer end 112C coupled to the base sheet 105. The first radial pocket inner end 111C can be different in length than the first radial pocket outer end 112C. For example, as shown for the illustrated embodiment, the first radial pocket inner end 111C can be longer than the first radial pocket outer end 112C.

In various embodiments, including the illustrated embodiment of the bed roll guard apparatus 100, at least one of the first radial pocket inner end 111C and the first radial pocket outer end 112C can be removably coupled to the base sheet 105. In the illustrated embodiment, the first radial pocket outer end 112C is removably coupled to the base sheet 105. For example, the first radial pocket outer end 112C can include a third fastening mechanism 124C to removably couple the first radial pocket outer end 112C to the base sheet 105. In one embodiment, the third fastening mechanism 124C can be a third zipper, with the first radial pocket outer end 112C including a third zipper first portion 125C and the base sheet 105 including a third zipper second portion 126C. The third zipper first portion 125C can be complementary to the third zipper second portion 126C such that the third zipper first portion 125C is configured to be removably coupled to the third zipper second portion 126C to removably couple the first radial pocket outer end 112C to the base sheet 105. Also, when the third fastening mechanism 124C is a zipper it can further include a third movable zipper member 127C that is configured to move along both the complementary third zipper first portion 125C and third zipper second portion 126C to cause the third zipper first portion 125C and third zipper second portion 126C to mesh, and thus couple, when the third movable zipper member 127C is moved there along in a first direction and to cause the third zipper first portion 125C and third zipper second portion 126C to separate, and thus de-couple, when the third movable zipper member 127C is moved in a second, opposite direction there along.

In some embodiments where one of the first radial pocket inner end 111C and the first radial pocket outer end 112C is removably coupled to the base sheet 105, the other one of the first radial pocket inner end 111C and first radial pocket outer end 112C can be non-removably coupled to the base sheet 105. For instance, the other one of the first radial pocket inner end 111C and first radial pocket outer end 112C can be non-removably coupled to the base sheet 105 via stitching 128C between the other, non-removably coupled one of the first radial pocket inner end 111C and first radial pocket outer end 112C and the base sheet 105. In the illustrated embodiment, the first radial pocket outer end 112C is removably coupled to the base sheet 105 via the third fastening mechanism 124C while the first radial pocket inner end 111C is non-removably coupled to the base sheet 105 via the stitching 128C between the first radial pocket inner end 111C and the base sheet 105.

The first radial pocket 110C can further include, at a first longitudinal end of the first radial pocket 110C, a first radial pocket first longitudinal end 120C, and the first radial pocket 110C can further include, at a second longitudinal end of the first radial pocket 110C, a first radial pocket second longitudinal end 121C. The first longitudinal end of the first radial pocket 110C can be opposite the second longitudinal end of the first radial pocket 110C. The first radial pocket first longitudinal end 120C can extend at an oblique angle between the first radial pocket inner end 111C and the first radial pocket outer end 112C at the first longitudinal end of the first radial pocket 110C. For instance, the first radial pocket first longitudinal end 120C can extend between the first radial pocket inner end 111C and the first radial pocket outer end 112C at an angle between ten and eighty degrees, between twenty and seventy degrees, or between thirty and sixty degrees. Moreover, in some examples, such as that illustrated, the first radial pocket first longitudinal end 120C can extend at the oblique angle, between the first radial pocket inner end 111C and the first radial pocket outer end 112C, at a curved (e.g., non-linear) orientation. And, likewise, the first radial pocket second longitudinal end 121C can extend at an oblique angle between the first radial pocket inner end 111C and the first radial pocket outer end 112C at the second, opposite longitudinal end of the first radial pocket 110C. For instance, the first radial pocket second longitudinal end 121C can extend between the first radial pocket inner end 111C and the first radial pocket outer end 112C at an angle between ten and eighty degrees, between twenty and seventy degrees, or between thirty and sixty degrees. Moreover, in some examples, such as that illustrated, the first radial pocket second longitudinal end 121C can extend at the oblique angle, between the first radial pocket inner end 111C and the first radial pocket outer end 112C, at a curved (e.g., non-linear) orientation.

The first radial pocket 110C can be configured to receive and hold at least a portion of the third bolster 115C. In particular, the first radial pocket 110C can define a third bolster receptacle space 113C between the first radial pocket 110C and the base sheet 105, and the third bolster receptacle space 113C can be configured to receive and hold the third bolster 115C. The first radial pocket first longitudinal end 120C can define a fifth bolster opening 122C, at the first radial pocket 110C, leading to the third bolster receptacle space 113C between the first radial pocket 110C and the base sheet 105. And, the first radial pocket second longitudinal end 121C can define a sixth bolster opening 123C, at the first radial pocket 110C, leading to the third bolster receptacle space 113C between the first radial pocket 110C and the base sheet 105. As shown, this sixth bolster opening 123C can thus be located at an opposite end of the first radial pocket 110C from the fifth bolster opening 122C. As such, the third bolster receptacle space 113C can be bounded by the first radial pocket inner end 111C, the first radial pocket outer end 112C, the first radial pocket first longitudinal end 120C, the first radial pocket second longitudinal end 121C, and the portion of the first radial pocket 110C extending between these ends 111C, 112C, 120C, 121C. The third bolster 115C can be received at the third bolster receptacle space 113C. Indeed, in some embodiments, such as that shown at FIG. 1, the third bolster receptacle space 113C can be configured to receive and hold a central region of the third bolster 115C while opposite longitudinal end portions of the third bolster 115C can extend outside of the third bolster receptacle space 113C.

The second radial pocket 110D can have a configuration and features similar to, or the same as, that shown and described for the first radial pocket 110C.

The second radial pocket 110D can include a second radial pocket inner end 111D coupled to the base sheet 105 and a second radial pocket outer end (not seen in the view of FIG. 1) coupled to the base sheet 105. The second radial pocket inner end 111D can be different in length than the second radial pocket outer end. For example, the second radial pocket inner end 111D can be longer than the second radial pocket outer end.

In various embodiments, including the illustrated embodiment of the bed roll guard apparatus 100, at least one of the second radial pocket inner end 111D and the second radial pocket outer end can be removably coupled to the base sheet 105. In the illustrated embodiment, the second radial pocket outer end is removably coupled to the base sheet 105. For example, the second radial pocket outer end can include a fourth fastening mechanism that can be similar to, or the same as, the third fastening mechanism 124C described previously with respect to the first radial pocket 110C to removably couple the second radial pocket outer end to the base sheet 105.

In some embodiments where one of the second radial pocket inner end 111D and the second radial pocket outer end is removably coupled to the base sheet 105, the other one of the second radial pocket inner end 111D and second radial pocket outer end can be non-removably coupled to the base sheet 105. For instance, the other one of the second radial pocket inner end 111D and second radial pocket outer end can be non-removably coupled to the base sheet 105 via stitching 128D between the other, non-removably coupled one of the second radial pocket inner end 111D and second radial pocket outer end and the base sheet 105. In the illustrated embodiment, the second radial pocket outer end is removably coupled to the base sheet 105 via the fourth fastening mechanism while the second radial pocket inner end 111D is non-removably coupled to the base sheet 105 via the stitching 128D between the second radial pocket inner end 111D and the base sheet 105.

The second radial pocket 110D can further include, at a first longitudinal end of the second radial pocket 110D, a second radial pocket first longitudinal end 120D, and the second radial pocket 110D can further include, at a second longitudinal end of the second radial pocket 110D, a second radial pocket second longitudinal end 121D. The first longitudinal end of the second radial pocket 110D can be opposite the second longitudinal end of the second radial pocket 110D. The second radial pocket first longitudinal end 120D can extend at an oblique angle between the second radial pocket inner end 111D and the second radial pocket outer end at the first longitudinal end of the second radial pocket 110D. For instance, the second radial pocket first longitudinal end 120D can extend between the second radial pocket inner end 111D and the second radial pocket outer end at an angle between ten and eighty degrees, between twenty and seventy degrees, or between thirty and sixty degrees. Moreover, in some examples, such as that illustrated, the second radial pocket first longitudinal end 120D can extend at the oblique angle, between the second radial pocket inner end 111D and the second radial pocket outer end, at a curved (e.g., non-linear) orientation. And, likewise, the second radial pocket second longitudinal end 121D can extend at an oblique angle between the second radial pocket inner end 111D and the second radial pocket outer end at the second, opposite longitudinal end of the second radial pocket 110D. For instance, the second radial pocket second longitudinal end 121D can extend between the second radial pocket inner end 111D and the second radial pocket outer end at an angle between ten and eighty degrees, between twenty and seventy degrees, or between thirty and sixty degrees. Moreover, in some examples, such as that illustrated, the second radial pocket second longitudinal end 121D can extend at the oblique angle, between the second radial pocket inner end 111D and the second radial pocket outer end, at a curved (e.g., non-linear) orientation.

The second radial pocket 110D can be configured to receive and hold at least a portion of the fourth bolster 115D. In particular, the second radial pocket 110D can define a fourth bolster receptacle space 113D between the second radial pocket 110D and the base sheet 105, and the fourth bolster receptacle space 113D can be configured to receive and hold the fourth bolster 115D. The second radial pocket first longitudinal end 120D can define a seventh bolster opening 122D, at the second radial pocket 110D, leading to the fourth bolster receptacle space 113D between the second radial pocket 110D and the base sheet 105. And, the second radial pocket second longitudinal end 121D can define an eighth bolster opening 123D, at the second radial pocket 110D, leading to the fourth bolster receptacle space 113D between the second radial pocket 110D and the base sheet 105. As shown, this eighth bolster opening 123D can thus be located at an opposite end of the second radial pocket 110D from the seventh bolster opening 122D. As such, the fourth bolster receptacle space 113D can be bounded by the second radial pocket inner end 111D, the second radial pocket outer end, the second radial pocket first longitudinal end 120D, the second radial pocket second longitudinal end 121D, and the portion of the second radial pocket 110D extending between these ends 111D, the second radial pocket outer end, 120D, 121D. The fourth bolster 115D can be received at the fourth bolster receptacle space 113D. Indeed, in some embodiments, such as that shown at FIG. 1, the fourth bolster receptacle space 113D can be configured to receive and hold a central region of the fourth bolster 115D while opposite longitudinal end portions of the fourth bolster 115D can extend outside of the fourth bolster receptacle space 113D.

The described features and configurations with respect to the bed roll guard apparatus 100 can be useful, for instance, in facilitating efficient use of material so as to reduce material waste and, as a result, provide an environmentally conscious product. Yet, at the same time, these benefits can be achieved while providing a bed roll guard apparatus that is convenient to set up and capable of relatively easy portability (e.g., when removed from the mattress and when the bolsters are removed) and storage.

Figure 2:
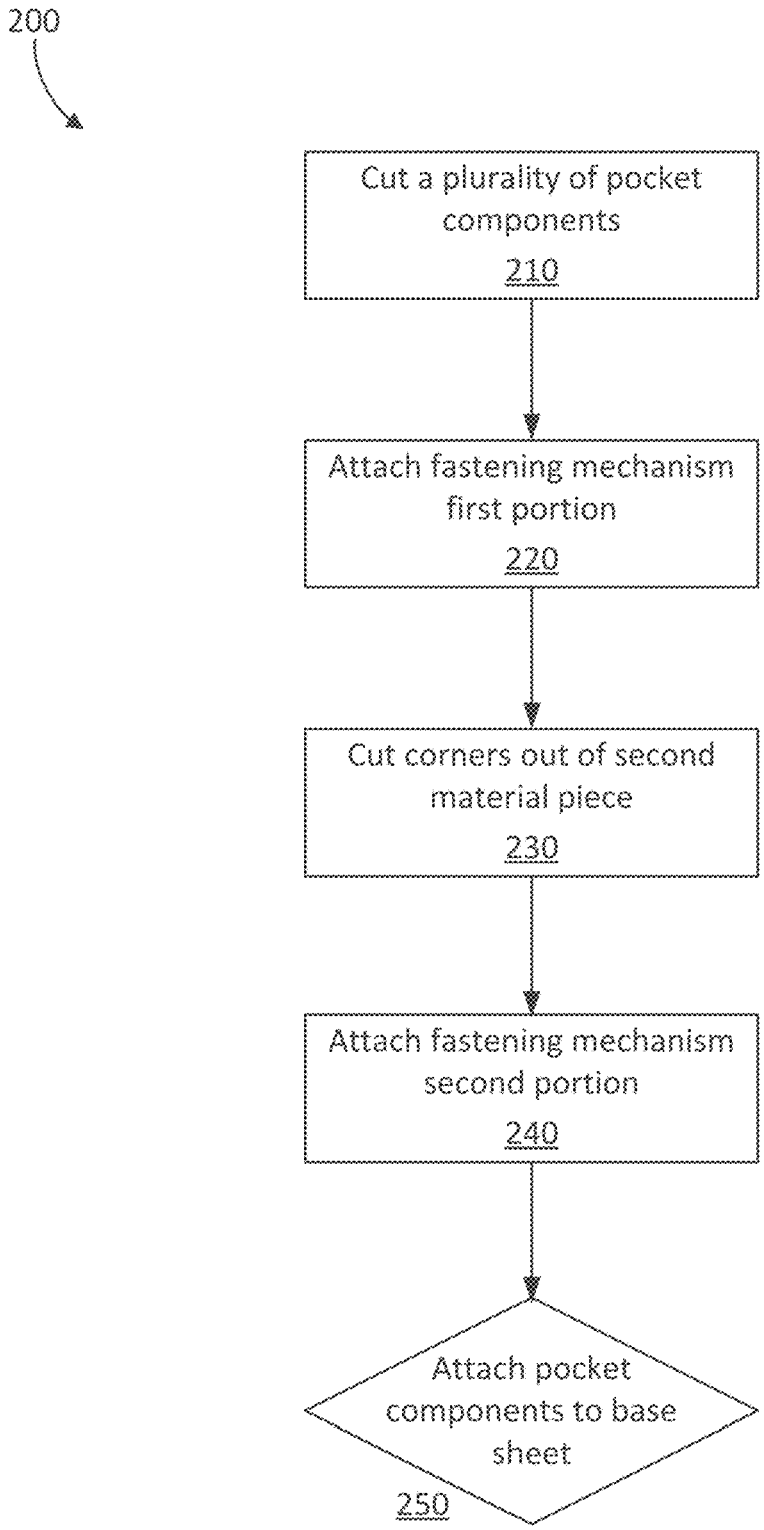
FIG. 2 is a flow diagram of an embodiment of a method of making a bed roll guard apparatus.

FIG. 2 is a flow diagram of an embodiment of a method 200 of making a bed roll guard apparatus. For example, the method 200 can be executed to make a bed roll guard apparatus having one or more of the features and/or configurations shown and described with respect to FIG. 1. As one specific such example, the method 200 can be executed to make the embodiment of the bed roll guard apparatus 100 described in reference to FIG. 1. FIGS. 3A-3G show an exemplary sequence for making a bed roll guard apparatus and these drawings will be referred to as follows when describing the method 200.

Figure 3A:
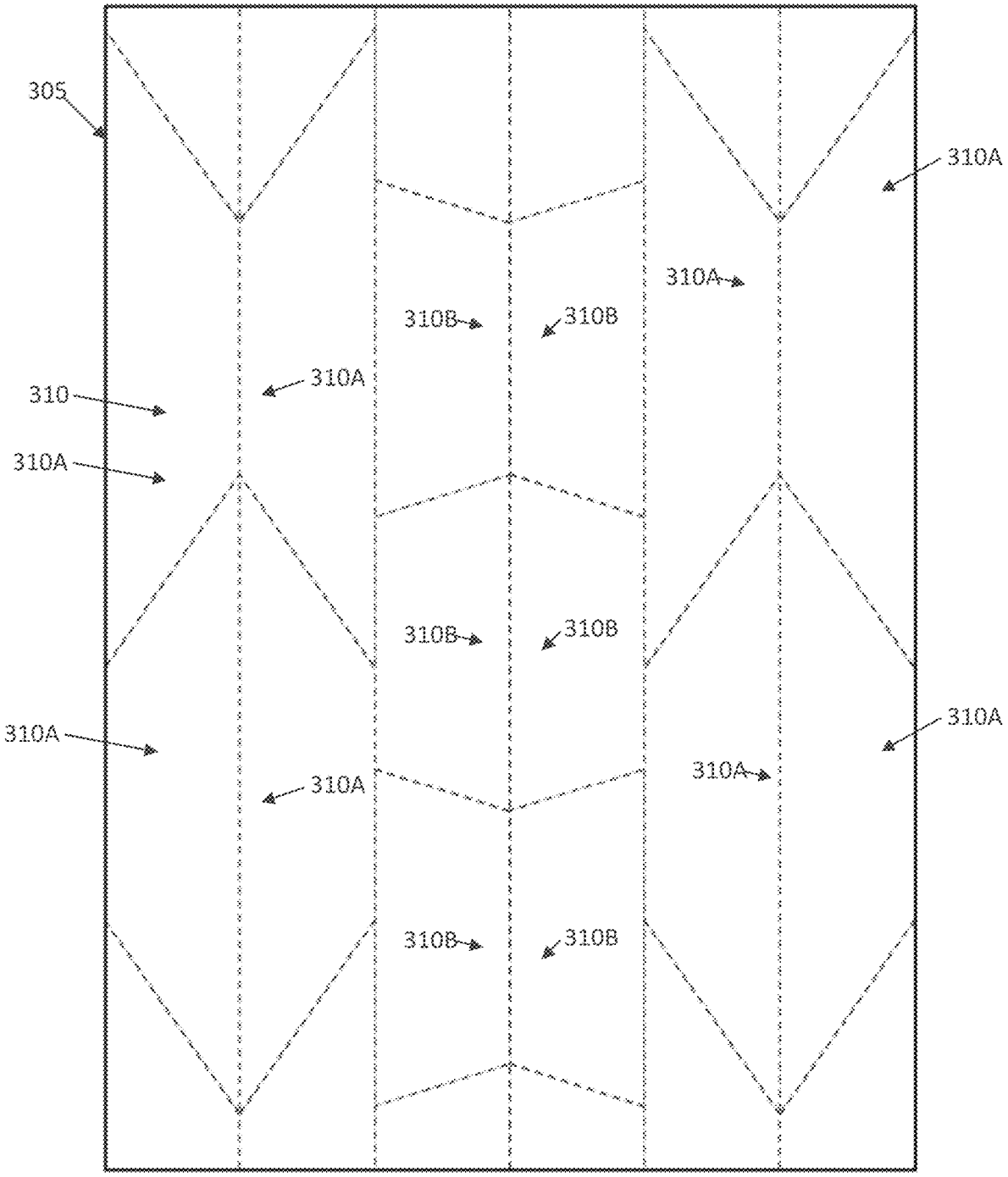
FIGS. 3A-3G show an exemplary sequence for making a bed roll guard apparatus.

At step 210, the method 200 includes cutting a plurality of pocket components out of a first material piece. For example, FIG. 3A is a top plan view of a first material piece 305 from which a plurality of pocket components 310 can be cut out at step 210. In one such specific embodiment, the plurality of pocket components 310 cut out of the first material piece 305 can include a first plurality of pocket components 310A each defining a first area and a second plurality of pocket components 310B each defining a second area, with the second area being different than the first area. Namely, in the illustrated embodiment of FIG. 3A, the first area defined by the first plurality of pocket components 310A can be larger than the second area defined by the second plurality of pocket components 310B. As also shown in the illustrated embodiment of FIG. 3A, each of the first plurality of pocket components 310A and the second plurality of pocket components 310B can be cut so as to have two, opposite sides of equal length and another two, opposite sides of different length. As one such example, as shown in the illustrated embodiment of FIG. 3A, each of the first plurality of pocket components 310A and the second plurality of pocket components 310B can be cut as a trapezoid shape from the first material piece 305. The different length, opposite sides of each of the pocket components 310A, 310B (e.g., the trapezoid shape) can be useful in reducing the amount of raw material needed for the plurality of pocket components 310. But, yet, at the same time each of the pocket components 310A, 310B can still be configured to provide sufficient surface area at the plurality of pocket components 310 to suitably receive, hold, and retain the bolsters at the bolster receptacles spaces between each of the plurality of pocket components 310 and the base sheet 105.

Figure 3B:
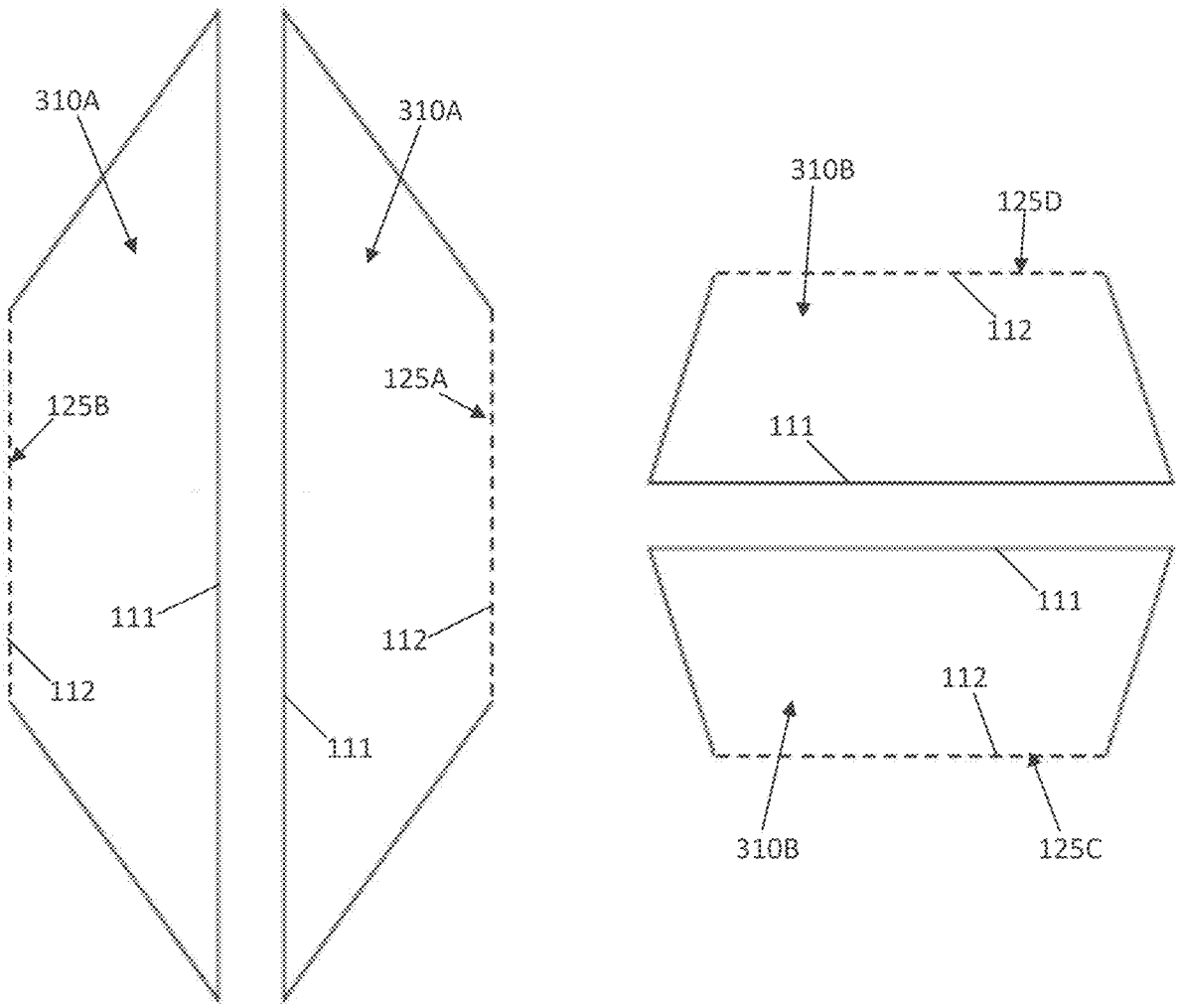

At step 220, the method 200 includes attaching a fastening mechanism first portion to each of the plurality of pocket components 310. For example, FIG. 3B is a top plan view of the plurality of the pocket components 310 with the fastening mechanism first portion 125A, 125B, 125C, or 125D attached to each of the pocket components 310A, 310B. As also shown in the embodiment of FIG. 3B, the plurality of pocket components 310 each include an inner end 111 and an outer end 112, with the inner end 111 being positioned at an opposite end of each of the plurality of pocket components 310 from the outer end 112. The inner end 111 can be longer than the outer end 112, and the respective fastening mechanism first portion 125A, 125B, 125C, 125D is attached to the outer end 112, or the shorter end 112, of the respective pocket component 310A, 310B.

Figure 3C:
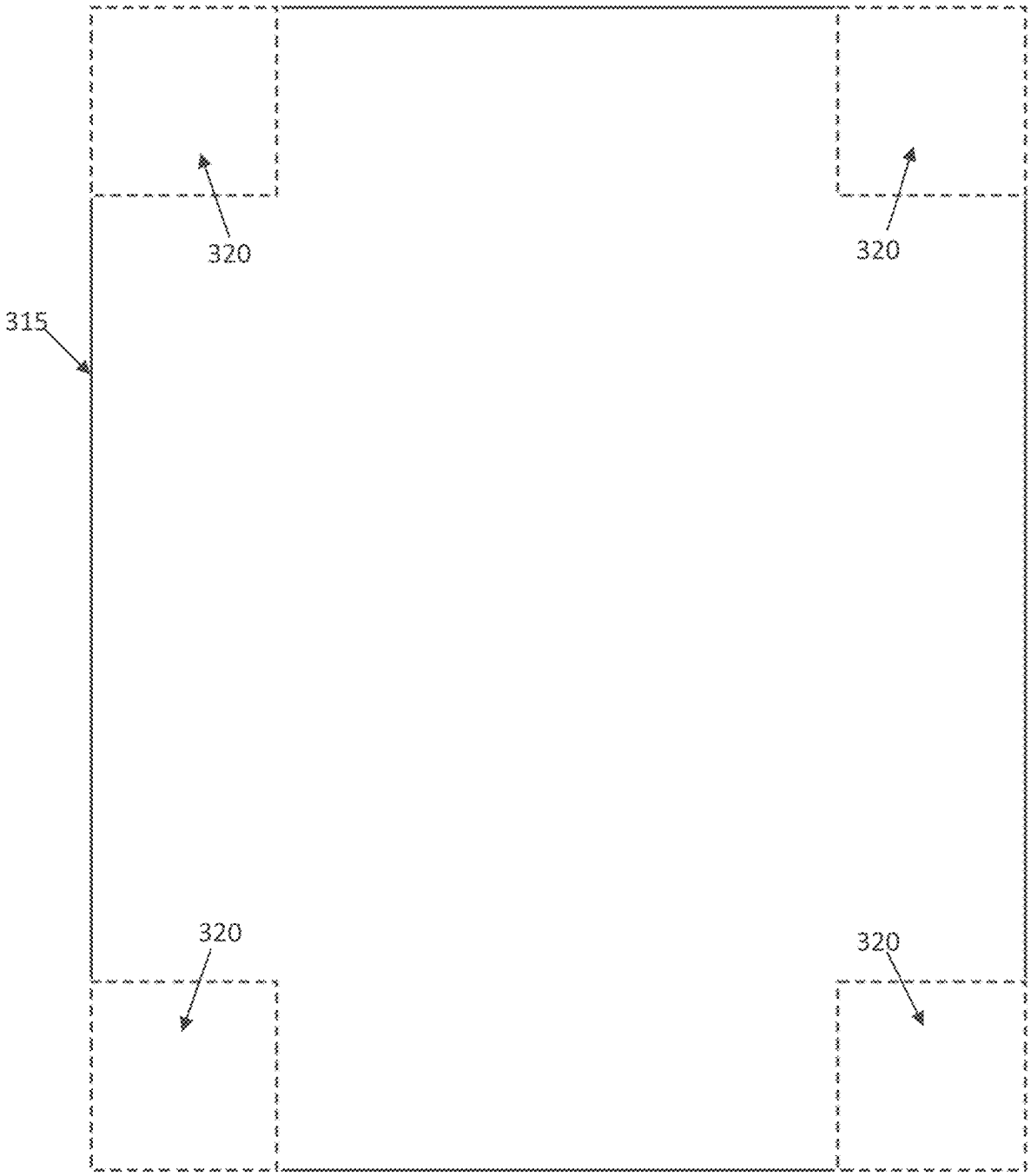
Figure 3D:
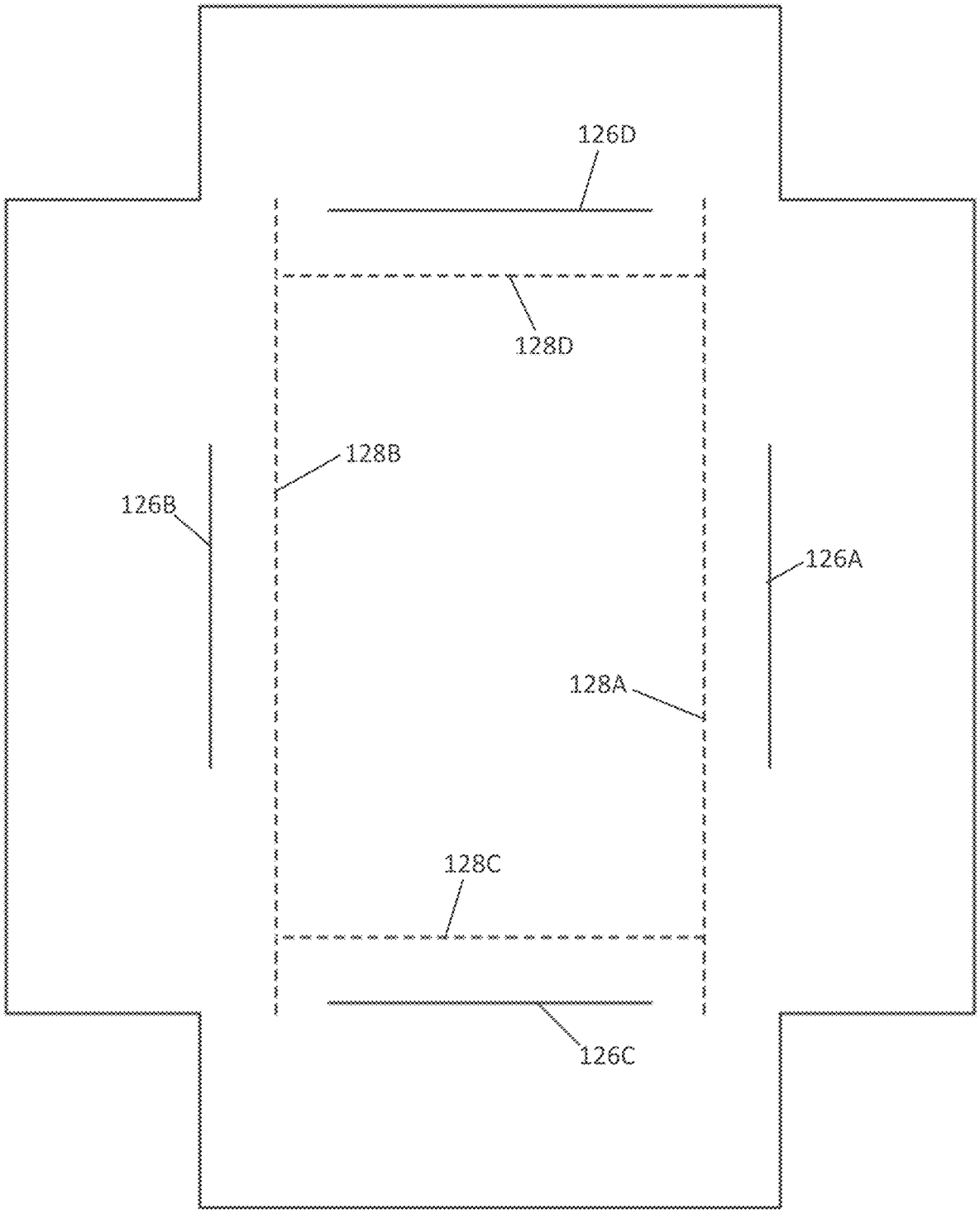
Figure 3E:
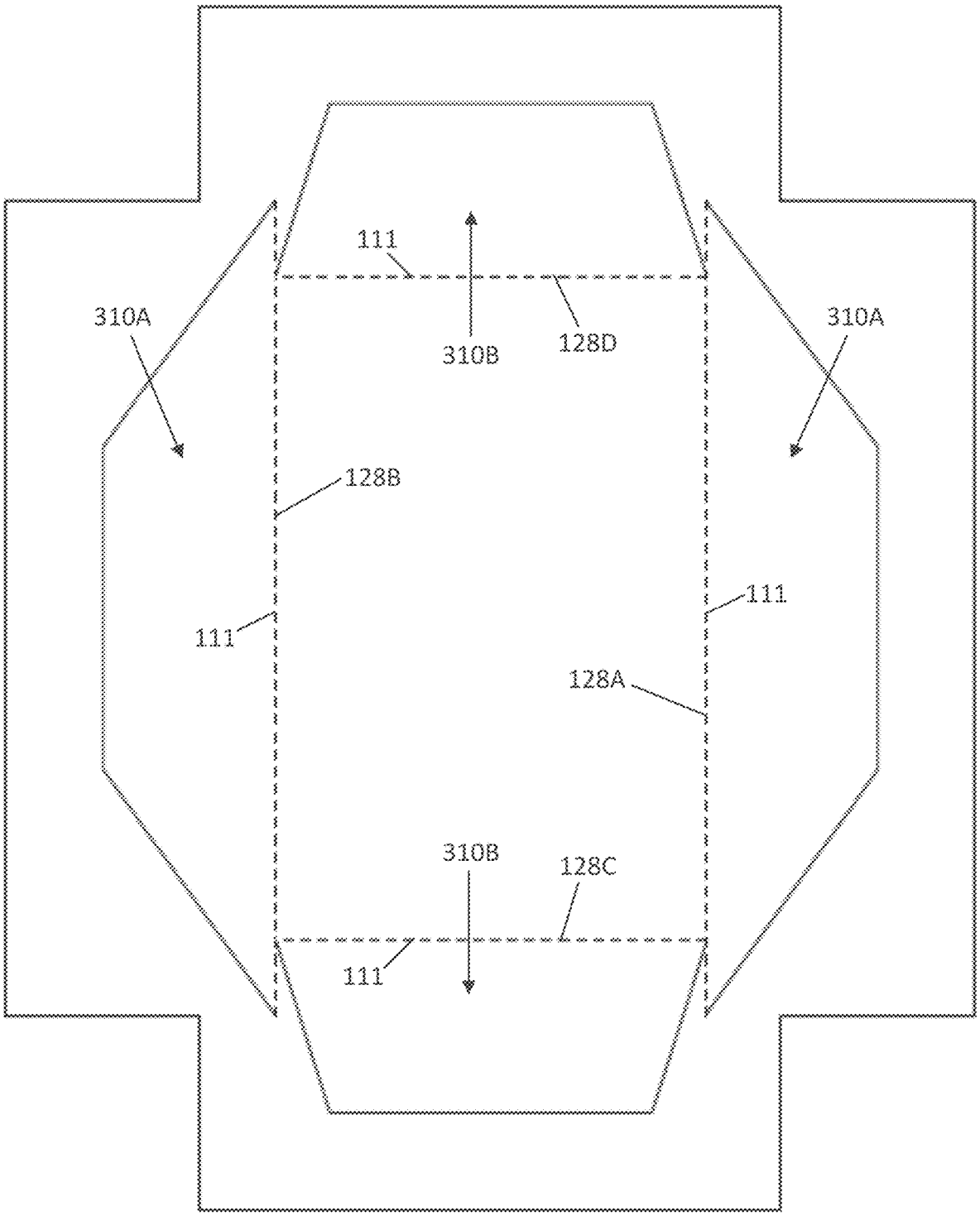
Figure 3F:
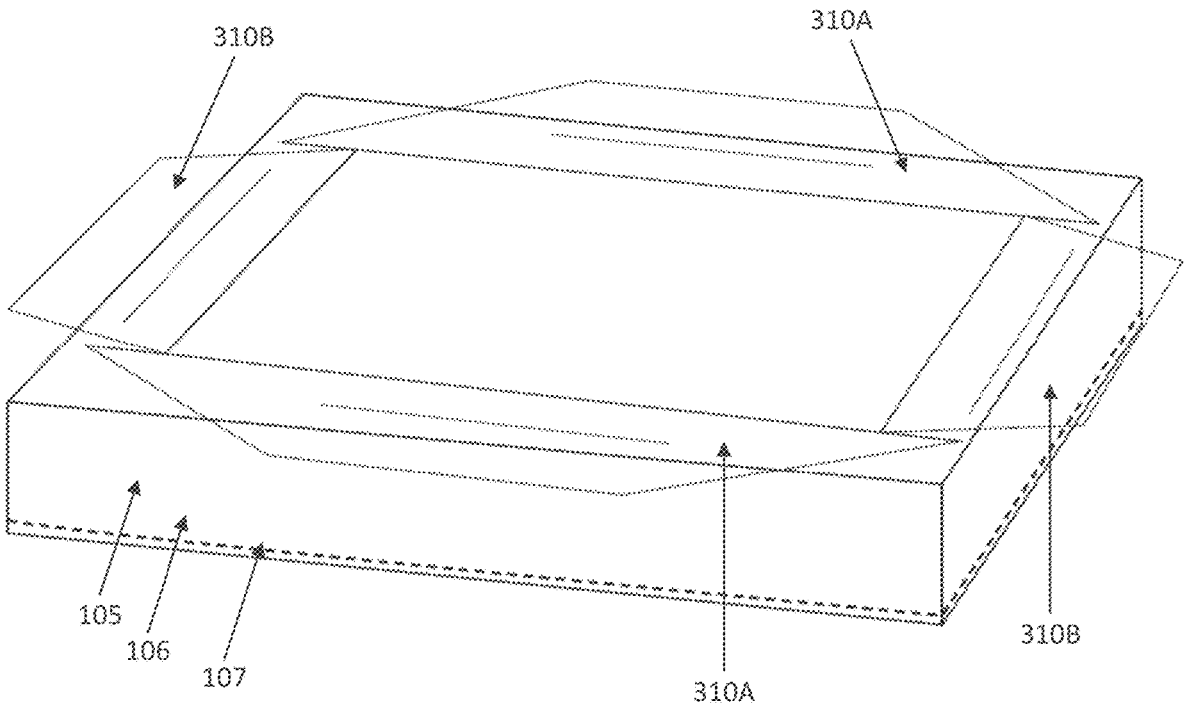

At step 230, the method 200 includes cutting corners 320 (e.g., each of four corners 320) out of a second material piece 315 to form the base sheet 105. For example, FIG. 3C is a top plan view of the second material piece 315 from which the base sheet 105 can be formed by, at least in part, cutting the corners 320 off of the second material piece 315. As seen at FIGS. 1 and 3F, the base sheet 105 can include an end portion 106 having an elastic band 107 that is configured to be secured to a mattress.

At step 240, the method 200 includes attaching a plurality of fastening mechanism second portions to the base sheet. At step 240, the plurality of fastening mechanism second portions can be attached to the base sheet at locations on the base sheet inward from the end portion having the elastic band (e.g., the plurality of second fastening mechanisms can be located on the base sheet so as to be bounded by the elastic band). Each fastening mechanism second portion can be configured to removably couple to the fastening mechanism first portion of a respective one of the plurality of pocket components 310 to removably couple the respective one of the plurality of pocket components 310 to the base sheet. For example, FIG. 3D is a top plan view of the previously formed base sheet with a plurality of fastening mechanism second portions 126A, 126B, 126C, and 126D attached to the base sheet at various locations. Each of the fastening mechanism second portions 126A, 126B, 126C, and 126D can be configured to removably couple to a respective, complementary one of the fastening mechanism first portions 125A, 125B, 125C, 125D at each of the plurality of the pocket components 310. In one such example, the first and second fastening mechanisms can, respectively, be complementary first and second zipper portions.

FIG. 3D also shows location of stitching 128A, 128B, 128C, 128D that can be placed along the base sheet. As described previously, an end of each of the plurality of pocket components 310 (e.g., the inner end 111) can be non-removably coupled to the base sheet via one of the respective stitchings 128A, 128B, 128C, 128D between the end of the respective pocket component 310 and the base sheet. As such, each of the plurality of pocket components 310 can be attached to the base sheet via a respective stitching 128A, 128B, 128C, or 128D along the end of the inner end (e.g., longer end) of each respective pocket component 310. FIG. 3E shows a top plan view of the base sheet with the pocket components 310 attached to the base sheet at locations spaced apart from the fastening mechanism second portions at the base sheet. In particular, FIG. 3E shows each of the pocket components 310A, 310B coupled to the base sheet via a respective stitching 128A, 128B, 128C, 128D. As shown here, the inner end 111 of one pocket components 310A is stitched to the base sheet via the stitching 128A and the inner end 111 of the other pocket component 310A is stitched to the base sheet via the stitching 128B. Likewise, as also shown here, the inner end 111 of one pocket component 310B is stitched to the base sheet via the stitching 128C and the inner end 111 of the other pocket component 310B is stitched to the base sheet via the stitching 128D.

At step 250, the method 200 includes attaching the plurality of pocket components 310 to the base sheet to form a bolster receptacle space between each of the plurality of pocket components 310 and the base sheet. Each of the plurality of pocket components 310 can be attached to the base sheet, for example, via both the respective stitching 128A, 128B, 128C, 128D to the base sheet and the coupling between the fastening mechanism first portion of each of the plurality of pocket components 310 to a respective one of the fastening mechanism second portions (e.g., a respective one of the fastening mechanism second portions previously attached to the base sheet at step 240). In this way, each of the plurality of pocket components 310 can have a non-removable coupling to the base sheet via the respective stitching to the base sheet and a removable coupling to the base sheet via the respective complementary coupling of the first and second fastening mechanism portions.

FIG. 3F shows a perspective view of the base sheet 105, along with the pocket components 310A, 310B attached to the base sheet 105 via the respective stitching 128A, 128B, 128C, 128D. FIG. 3F also shows the elastic band 107 attached to the end portion 106 of the base sheet 105. Thus, in some cases, the method 200 can also include a step of attaching the elastic band 107 to the end portion 106 of the base sheet 105. The elastic band 107 can be configured to be secured to a mattress so as to removably secure the base sheet 105 to the mattress.

Figure 3G:
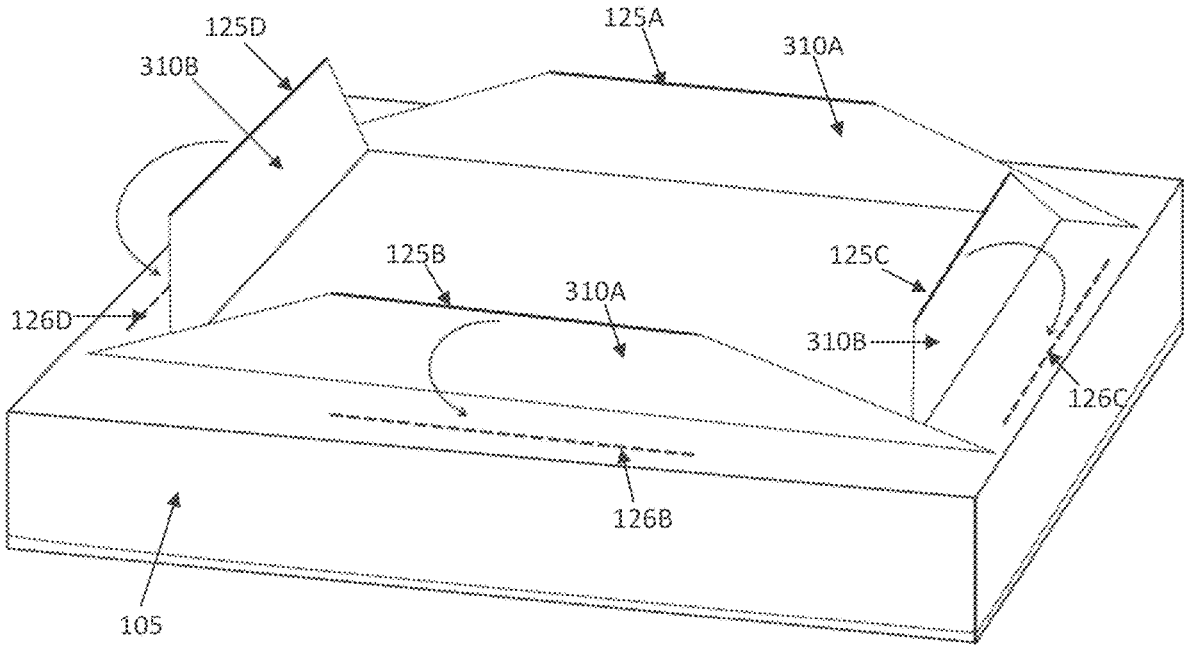

FIG. 3G shows a perspective view of the pocket components 310A, 310B being removably coupled to the base sheet 105 via the complementary fastening mechanism first portions 125A, 125B, 125C, 125D and fastening mechanism second portions 126A, 126B, 126C, 126D so as to form a bolster receptacle space between each of the plurality of pocket components 310 and the base sheet 105. Specifically, FIG. 3G shows how each of the pocket components 310A, 310B, after being stitched to the base sheet 105, can be folded (e.g., in the direction of the directional arrows included in FIG. 3G) so as to align the respective fastening mechanism first and second portions 125A, 126A, 125B, 126B, 125C, 126C, 125D, 126D. Then, once aligned, the respective fastening mechanism first and second portions 125A, 126A, 125B, 126B, 125C, 126C, 125D, 126D can be removably coupled together (e.g., by moving the movable zipper member of each fastening mechanism). For each pocket component 310A, 310B, the combination of the stitched coupling to the base sheet 105 (e.g., at the inner end of each pocket component 310A, 310B) and the fastening mechanism first and second portion coupling to the base sheet 105 can form the bolster receptacle space between each pocket component 310A, 310B and the base sheet 105. And, the bolster receptacle space formed between each pocket component 310A, 310B and the base sheet 105 can be configured to receive a bolster thereat.

Various non-limiting exemplary embodiments have been described. It will be appreciated that suitable alternatives are possible without departing from the scope of the examples described herein. These and other examples are within the scope of the following claims.

What is claimed is:

1. A bed roll guard apparatus comprising:

a base sheet, the base sheet including an end portion having an elastic band that is configured to be secured to a mattress;

a first longitudinal pocket, the first longitudinal pocket including a first longitudinal pocket inner end coupled to the base sheet and a first longitudinal pocket outer end coupled to the base sheet, the first longitudinal pocket inner end being different in length than the first longitudinal pocket outer end, the first longitudinal pocket defining a first bolster receptacle space between the first longitudinal pocket and the base sheet;

a first bolster received at the first bolster receptacle space;

a second longitudinal pocket, the second longitudinal pocket including a second longitudinal pocket inner end coupled to the base sheet and a second longitudinal pocket outer end coupled to the base sheet, the second longitudinal pocket inner end being different in length than the second longitudinal pocket outer end, the second longitudinal pocket defining a second bolster receptacle space between the second longitudinal pocket and the base sheet; and a second bolster received at the second bolster receptacle space, wherein the first longitudinal pocket outer end includes a first fastening mechanism to removably couple the first longitudinal pocket outer end to the base sheet, wherein the second longitudinal pocket outer end includes a second fastening mechanism to removably couple the second longitudinal pocket outer end to the base sheet, wherein the first longitudinal pocket inner end is longer than the first longitudinal pocket outer end, and wherein the second longitudinal pocket inner end is longer than the second longitudinal pocket outer end, wherein the first longitudinal pocket further includes a first longitudinal pocket first radial end extending at an oblique angle between the first longitudinal pocket inner end and the first longitudinal pocket outer end at a first radial end of the first longitudinal pocket, and wherein the first longitudinal pocket further includes a first longitudinal pocket second radial end extending at an oblique angle between the first longitudinal pocket inner end and the first longitudinal pocket outer end at a second radial end of the first longitudinal pocket, the first radial end of the first longitudinal pocket being opposite the second radial end of the first longitudinal pocket.

2. The apparatus of claim 1, wherein the first fastening mechanism is a first zipper, wherein the first longitudinal pocket outer end includes a first zipper first portion and the base sheet includes a first zipper second portion, and wherein the first zipper first portion is complementary to the first zipper second portion such that the first zipper first portion is configured to be removably coupled to the first zipper second portion to removably couple the first longitudinal pocket outer end to the base sheet.

3. The apparatus of claim 2, wherein the second fastening mechanism is a second zipper, wherein the second longitudinal pocket outer end includes a second zipper first portion and the base sheet includes a second zipper second portion, and wherein the second zipper first portion is complementary to the second zipper second portion such that the second zipper first portion is configured to be removably coupled to the second zipper second portion to removably couple the second longitudinal pocket outer end to the base sheet.

4. The apparatus of claim 1, wherein the first longitudinal pocket first radial end defines a first bolster opening, at the first longitudinal pocket, leading to the first bolster receptacle space between the first longitudinal pocket and the base sheet.

5. The apparatus of claim 4, wherein the first longitudinal pocket second radial end defines a second bolster opening, at the first longitudinal pocket, leading to the first bolster receptacle space between the first longitudinal pocket and the base sheet, the second bolster opening being located at an opposite end of the first longitudinal pocket from the first bolster opening.

6. The apparatus of claim 1, further comprising:

a first radial pocket, the first radial pocket including a first radial pocket inner end coupled to the base sheet and a first radial pocket outer end coupled to the base sheet, the first radial pocket inner end being different in length than the first radial pocket outer end, the first radial pocket defining a third bolster receptacle space between the first radial pocket and the base sheet; and a third bolster received at the third bolster receptacle space.

7. The apparatus of claim 6, wherein the first radial pocket inner end is longer than the first radial pocket outer end.

8. The apparatus of claim 7, wherein the first radial pocket outer end includes a first fastening mechanism to removably couple the first radial pocket outer end to the base sheet.

9. The apparatus of claim 8, wherein the first fastening mechanism is a first zipper, wherein the first radial pocket outer end includes a first zipper first portion and the base sheet includes a first zipper second portion, and wherein the first zipper first portion is complementary to the first zipper second portion such that the first zipper first portion is configured to be removably coupled to the first zipper second portion to removably couple the first radial pocket outer end to the base sheet.

10. A bed roll guard apparatus comprising:

a base sheet, the base sheet including an end portion having an elastic band that is configured to be secured to a mattress;

a first longitudinal pocket, the first longitudinal pocket including a first longitudinal pocket inner end coupled to the base sheet and a first longitudinal pocket outer end coupled to the base sheet, the first longitudinal pocket inner end being different in length than the first longitudinal pocket outer end, the first longitudinal pocket defining a first bolster receptacle space between the first longitudinal pocket and the base sheet;

a first bolster received at the first bolster receptacle space;

a second longitudinal pocket, the second longitudinal pocket including a second longitudinal pocket inner end coupled to the base sheet and a second longitudinal pocket outer end coupled to the base sheet, the second longitudinal pocket inner end being different in length than the second longitudinal pocket outer end, the second longitudinal pocket defining a second bolster receptacle space between the second longitudinal pocket and the base sheet;

a second bolster received at the second bolster receptacle space;

a first radial pocket, the first radial pocket including a first radial pocket inner end coupled to the base sheet and a first radial pocket outer end coupled to the base sheet, the first radial pocket inner end being different in length than the first radial pocket outer end, the first radial pocket defining a third bolster receptacle space between the first radial pocket and the base sheet; and a third bolster received at the third bolster receptacle space, wherein the first radial pocket inner end is longer than the first radial pocket outer end, wherein the first radial pocket outer end includes a first fastening mechanism to removably couple the first radial pocket outer end to the base sheet, wherein the first longitudinal pocket outer end includes a first fastening mechanism to removably couple the first longitudinal pocket outer end to the base sheet, wherein the second longitudinal pocket outer end includes a second fastening mechanism to removably couple the second longitudinal pocket outer end to the base sheet, wherein the first longitudinal pocket inner end is longer than the first longitudinal pocket outer end, and wherein the second longitudinal pocket inner end is longer than the second longitudinal pocket outer end, wherein the first fastening mechanism is a first zipper, wherein the first radial pocket outer end includes a first zipper first portion and the base sheet includes a first zipper second portion, and wherein the first zipper first portion is complementary to the first zipper second portion such that the first zipper first portion is configured to be removably coupled to the first zipper second portion to removably couple the first radial pocket outer end to the base sheet, wherein the first radial pocket further includes a first radial pocket first longitudinal end extending at an oblique angle between the first radial pocket inner end and the first radial pocket outer end at a first longitudinal end of the first radial pocket, and wherein the first radial pocket further includes a first radial pocket second longitudinal end extending at an oblique angle between the first radial pocket inner end and the first radial pocket outer end at a second longitudinal end of the first radial pocket, the first longitudinal end of the first radial pocket being opposite the second longitudinal end of the first radial pocket.

11. The apparatus of claim 10, wherein the first radial pocket first longitudinal end defines a third bolster opening, at the first radial pocket, leading to the third bolster receptacle space between the first radial pocket and the base sheet.

12. The apparatus of claim 10, wherein the first longitudinal pocket outer end includes a first fastening mechanism to removably couple the first longitudinal pocket outer end to the base sheet, wherein the second longitudinal pocket outer end includes a second fastening mechanism to removably couple the second longitudinal pocket outer end to the base sheet, wherein the first longitudinal pocket inner end is longer than the first longitudinal pocket outer end, and wherein the second longitudinal pocket inner end is longer than the second longitudinal pocket outer end, wherein the first longitudinal pocket further includes a first longitudinal pocket first radial end extending at an oblique angle between the first longitudinal pocket inner end and the first longitudinal pocket outer end at a first radial end of the first longitudinal pocket.

13. The apparatus of claim 12, wherein the first longitudinal pocket further includes a first longitudinal pocket second radial end extending at an oblique angle between the first longitudinal pocket inner end and the first longitudinal pocket outer end at a second radial end of the first longitudinal pocket, the first radial end of the first longitudinal pocket being opposite the second radial end of the first longitudinal pocket.

14. The apparatus of claim 10, wherein the first fastening mechanism is a first zipper, wherein the first longitudinal pocket outer end includes a first zipper first portion and the base sheet includes a first zipper second portion, and wherein the first zipper first portion is complementary to the first zipper second portion such that the first zipper first portion is configured to be removably coupled to the first zipper second portion to removably couple the first longitudinal pocket outer end to the base sheet.

15. The apparatus of claim 14, wherein the second fastening mechanism is a second zipper, wherein the second longitudinal pocket outer end includes a second zipper first portion and the base sheet includes a second zipper second portion, and wherein the second zipper first portion is complementary to the second zipper second portion such that the second zipper first portion is configured to be removably coupled to the second zipper second portion to removably couple the second longitudinal pocket outer end to the base sheet.

* * * * *